US009955799B2

(12) United States Patent
Tadipatri et al.

(10) Patent No.: US 9,955,799 B2
(45) Date of Patent: May 1, 2018

(54) CHILD MOTION DEVICE

(71) Applicant: KIDS II, INC., Atlanta, GA (US)

(72) Inventors: Chaitanya Tadipatri, Alpharetta, GA (US); Stephen R. Burns, Cumming, GA (US); Jacob Sclare, Dacula, GA (US)

(73) Assignee: KIDS II, INC., Atlanta, GA (US)

( * ) Notice: Subject to any disclaimer, the term of this patent is extended or adjusted under 35 U.S.C. 154(b) by 0 days. days.

(21) Appl. No.: 15/676,388

(22) Filed: Aug. 14, 2017

(65) Prior Publication Data

US 2017/0340137 A1 Nov. 30, 2017

Related U.S. Application Data

(63) Continuation of application No. 15/259,981, filed on Sep. 8, 2016, now Pat. No. 9,861,210.

(60) Provisional application No. 62/215,790, filed on Sep. 9, 2015.

(51) Int. Cl.

| | |
|---|---|
| ***A63G 9/16*** | (2006.01) |
| ***A47D 13/10*** | (2006.01) |
| ***A47D 9/04*** | (2006.01) |
| *A47D 13/00* | (2006.01) |

(52) U.S. Cl.

CPC ..... *A47D 13/105* (2013.01); *A47D 9/04* (2013.01)

(58) Field of Classification Search

CPC ... A63G 9/00; A63G 9/12; A63G 9/16; A47D 13/00; A47D 13/10; A47D 13/105; A47D 13/107; A47D 9/02; A47C 3/00; A47C 3/0255

USPC ..... 472/118–125; 297/260.1, 260.2; 5/108, 5/109

See application file for complete search history.

(56) References Cited

U.S. PATENT DOCUMENTS

| | | | |
|---|---|---|---|
| 138,320 | A | 4/1873 | Doremus |
| 204,944 | A | 6/1878 | Bernhard |
| 430,616 | A | 6/1890 | Brewer |
| 1,132,432 | A | 3/1915 | Brzozowski |
| 1,727,635 | A | 9/1929 | Crane |
| 1,906,768 | A | 5/1933 | Romine |
| 2,079,767 | A | 5/1937 | Larsen |
| 2,099,457 | A | 11/1937 | Vallone |
| 2,116,334 | A | 5/1938 | Woller et al. |
| 2,283,000 | A | 5/1942 | Feldman |
| 2,482,318 | A | 9/1949 | Carruth |
| 2,534,438 | A | 12/1950 | Gosselin |
| 2,845,635 | A | 8/1958 | Eyer |
| 3,125,767 | A | 3/1964 | Griggs et al. |

(Continued)

FOREIGN PATENT DOCUMENTS

| | | |
|---|---|---|
| EP | 2641511 A1 | 9/2013 |
| WO | 2007056655 A1 | 5/2007 |

*Primary Examiner* — Kien Nguyen
(74) *Attorney, Agent, or Firm* — Gardner Groff Greenwald & Villanueva, PC

(57) ABSTRACT

A child motion device including a support frame, a frame hub coupled to the support frame, a gliding swing mechanism pivotally mounted to the frame hub, and a cantilevered child support portion pivotally mounted to the gliding swing mechanism. In example embodiments, the child support portion can be in the form of a child seat or a bassinet. In example embodiments, the child support portion can be oriented between multiple seat-facing orientations for providing either of a side-to-side gliding movement or a front-to-back gliding movement.

32 Claims, 17 Drawing Sheets

(56) References Cited

U.S. PATENT DOCUMENTS 3,648,307 A 3/1972 Meade
3,806,117 A 4/1974 Foster
D251,518 S 4/1979 Boudreau et al.
4,323,233 A 4/1982 Gebhard
4,377,011 A 3/1983 Kinberger
4,536,029 A 8/1985 Rogers, Jr.
4,615,059 A 10/1986 Darowski
4,700,920 A 10/1987 Horn
4,744,599 A 5/1988 Jankowski et al.
4,805,902 A 2/1989 Casagrande
4,881,285 A 11/1989 Zeeb
4,936,629 A 6/1990 Young
D345,777 S 4/1994 Pinch et al.
5,307,531 A 5/1994 Kao
5,326,327 A 7/1994 Stephens et al.
D351,289 S 10/1994 Stephens et al.
5,376,053 A * 12/1994 Ponder ..... A63G 9/16 472/119
5,470,039 A 11/1995 Hilger
5,562,548 A 10/1996 Pinch et al.
5,572,752 A 11/1996 McGee
5,618,016 A 4/1997 Garland et al.
5,802,634 A 9/1998 Onishi et al.
6,027,170 A 2/2000 Benz et al.
6,092,870 A 7/2000 Desnoyers et al.
6,318,803 B1 11/2001 Garland
6,386,986 B1 5/2002 Sonner et al.
6,612,651 B1 9/2003 Garland
6,676,475 B1 1/2004 Henderson et al.
6,773,064 B2 8/2004 Treen et al.
6,854,138 B2 2/2005 Xu
6,908,398 B1 6/2005 Kang
7,189,164 B1 3/2007 Paesang et al.
7,258,617 B2 8/2007 Chen
7,281,284 B2 10/2007 Sims, Jr.
7,326,120 B2 2/2008 Bellows et al.
7,354,352 B2 4/2008 Keska et al.
7,445,559 B2 11/2008 Kakuda
7,445,560 B2 11/2008 Greger et al.
7,475,942 B2 1/2009 Boyle et al.
7,478,446 B2 1/2009 Sims, Jr.
7,563,170 B2 7/2009 Bellows et al.
7,607,734 B2 10/2009 Clapper et al.
7,717,798 B2 5/2010 Bellows et al.
7,722,118 B2 5/2010 Bapst et al.
7,727,078 B2 * 6/2010 Arnold, IV ..... A47C 7/725 446/227
7,770,971 B2 8/2010 Bellows et al.
7,788,744 B2 9/2010 Calilung et al.
7,789,762 B2 * 9/2010 Greger ..... A47D 9/02 472/118
7,837,570 B2 11/2010 Kwon
7,845,728 B2 12/2010 Chen et al.
7,874,927 B2 1/2011 Godiska
7,878,915 B2 2/2011 Myers et al.
7,883,426 B2 2/2011 Bellows et al.
7,884,710 B2 2/2011 Godiska et al.
7,938,731 B2 * 5/2011 Papageorge ..... A47D 9/02 297/250.1
7,959,514 B2 6/2011 Chen et al.
8,029,377 B2 10/2011 Velderman et al.
8,187,111 B2 5/2012 Velderman et al.
8,239,984 B2 8/2012 Hopke et al.
8,292,750 B2 10/2012 Gregorian
8,308,578 B2 11/2012 Gilbert et al.
8,357,054 B2 1/2013 Myers et al.
8,419,132 B2 4/2013 Jacobs
8,469,832 B2 6/2013 Gillett et al.
8,491,401 B2 7/2013 Szymanski
8,602,903 B2 12/2013 Gilbert
8,602,904 B2 12/2013 Tuckey et al.
8,646,129 B1 2/2014 Chen
8,684,856 B2 4/2014 Pyrce et al.
8,708,832 B2 4/2014 Gilbert et al.
8,784,226 B2 7/2014 Yang et al.
8,845,440 B2 9/2014 Haut
8,856,982 B1 10/2014 Kalivas
D717,574 S 11/2014 Bellows et al.
D717,577 S 11/2014 Pacella et al.
8,876,617 B2 11/2014 Robbins et al.
8,900,063 B2 12/2014 Lin
8,920,253 B2 12/2014 Horst et al.
8,951,132 B2 2/2015 Xu
9,033,809 B2 5/2015 Haut et al.
9,155,403 B2 10/2015 Mountz et al.
9,173,503 B2 11/2015 Mountz et al.
2003/0222485 A1 12/2003 Dwyer
2005/0014569 A1 1/2005 Greger et al.
2006/0181123 A1 8/2006 Gibree
2006/0270480 A1 11/2006 Chen
2008/0136236 A1 6/2008 Kincaid et al.
2008/0146359 A1 6/2008 Godiska
2008/0146361 A1 * 6/2008 Godiska ..... A47D 9/02 472/119
2009/0200844 A1 8/2009 Tibaldo
2010/0127539 A1 5/2010 Bellows et al.
2011/0227384 A1 9/2011 Huntsberger et al.
2011/0260507 A1 10/2011 Parness et al.
2012/0261962 A1 10/2012 Huntsberger et al.
2014/0315650 A1 10/2014 Pyrce et al.
2015/0289676 A1 10/2015 Huntsberger et al.
2015/0289677 A1 10/2015 Huntsberger et al.
2015/0342367 A1 12/2015 Corso et al.
2017/0065101 A1 3/2017 Tadipatri et al.

* cited by examiner

CHILD MOTION DEVICE

CROSS-REFERENCE TO RELATED APPLICATIONS

This application is a continuation of U.S. Non-Provisional patent application Ser. No. 15/259,981 filed Sep. 8, 2016, which claims the benefit of U.S. Provisional Patent Application Ser. No. 62/215,790 filed Sep. 9, 2015, the entireties of which are hereby incorporated herein by reference for all purposes.

TECHNICAL FIELD

The present invention relates generally to the field of children's motion devices and accessories, and more particularly to reconfigurable swinging, rocking, swaying and gliding motion devices.

BACKGROUND

Infant swings, gliders and rockers generally include a support frame and a seat (or other child receiving receptacle) movably supported by the support frame for providing motion to a child seated therein. Commonly, a single arm is pivotally mounted to the support frame and supports the child receiving receptacle, thereby providing a swinging motion to the child receiving receptacle. Such devices may introduce a significant degree of rolling motion to the child as the device rocks the child receiving receptacle along an arc with a relatively small radius of curvature that is typically limited by the length of the swing arm, which may cause discomfort for some children. The frames of such devices may also lack sufficient stability, or alternatively the footprint size of the support frame needed to provide a desired level of stability to such devices may be too large for convenient use in a home.

Needs exist for continuing improvements in this field of endeavor. It is to the provision of an improved motion device for children meeting these and other needs that the present invention is primarily directed.

SUMMARY

In example embodiments, the present invention provides an improved motion device for children. In example forms, the motion device imparts a stable side-to-side gliding motion to a child carried therein, with limited or no rolling motion, potentially reducing discomfort to the child.

In one aspect, the present invention relates to a child motion device including a support frame having a base portion configured for resting on a support surface, and an upright portion extending from the base portion. The child motion device preferably also includes a child support portion configured to support a child, and a pair of swing arms having first ends pivotally coupled to the upright portion of the support frame and second ends coupled to the child support portion. A pivoting side-to-side motion of the pair of swing arms generates a gliding side-to-side motion of the child support portion.

In another aspect, the invention relates to a child motion device including a support frame having a base portion and an upright portion. The base portion is preferably configured for resting upon a support surface and the upright portion preferably includes a frame hub. The child motion device preferably also includes a pair of swing arms having proximal ends pivotally coupled to the frame hub, a coupling supported by distal ends of the swing arms, and a child support portion configured for attachment to the coupling, whereby the coupling allows rotational repositioning of the child support portion relative to the support frame.

In still another aspect, the invention relates to a child motion device including a support frame, and first and second swing arms pivotally connected to the support frame at upper ends thereof. The upper ends of the first and second swing arms are spaced a first distance apart. The child motion device preferably also includes a child support portion carried on lower ends of the first and second swing arms. Lower ends of the first and second swing arms are spaced a second distance apart, the second distance being equal to or greater than the first distance.

These and other aspects, features and advantages of the invention will be understood with reference to the drawing figures and detailed description herein, and will be realized by means of the various elements and combinations particularly pointed out in the appended claims. It is to be understood that both the foregoing general description and the following brief description of the drawings and detailed description of example embodiments are explanatory of example embodiments of the invention, and are not restrictive of the invention, as claimed.

DETAILED DESCRIPTION OF EXAMPLE EMBODIMENTS

The present invention may be understood more readily by reference to the following detailed description of example embodiments taken in connection with the accompanying drawing figures, which form a part of this disclosure. It is to be understood that this invention is not limited to the specific devices, methods, conditions or parameters described and/or shown herein, and that the terminology used herein is for the purpose of describing particular embodiments by way of example only and is not intended to be limiting of the claimed invention. Any and all patents and other publications identified in this specification are incorporated by reference as though fully set forth herein.

Also, as used in the specification including the appended claims, the singular forms "a," "an," and "the" include the plural, and reference to a particular numerical value includes at least that particular value, unless the context clearly dictates otherwise. Ranges may be expressed herein as from "about" or "approximately" one particular value and/or to "about" or "approximately" another particular value. When such a range is expressed, another embodiment includes from the one particular value and/or to the other particular value. Similarly, when values are expressed as approximations, by use of the antecedent "about," it will be understood that the particular value forms another embodiment.

Figure 1:
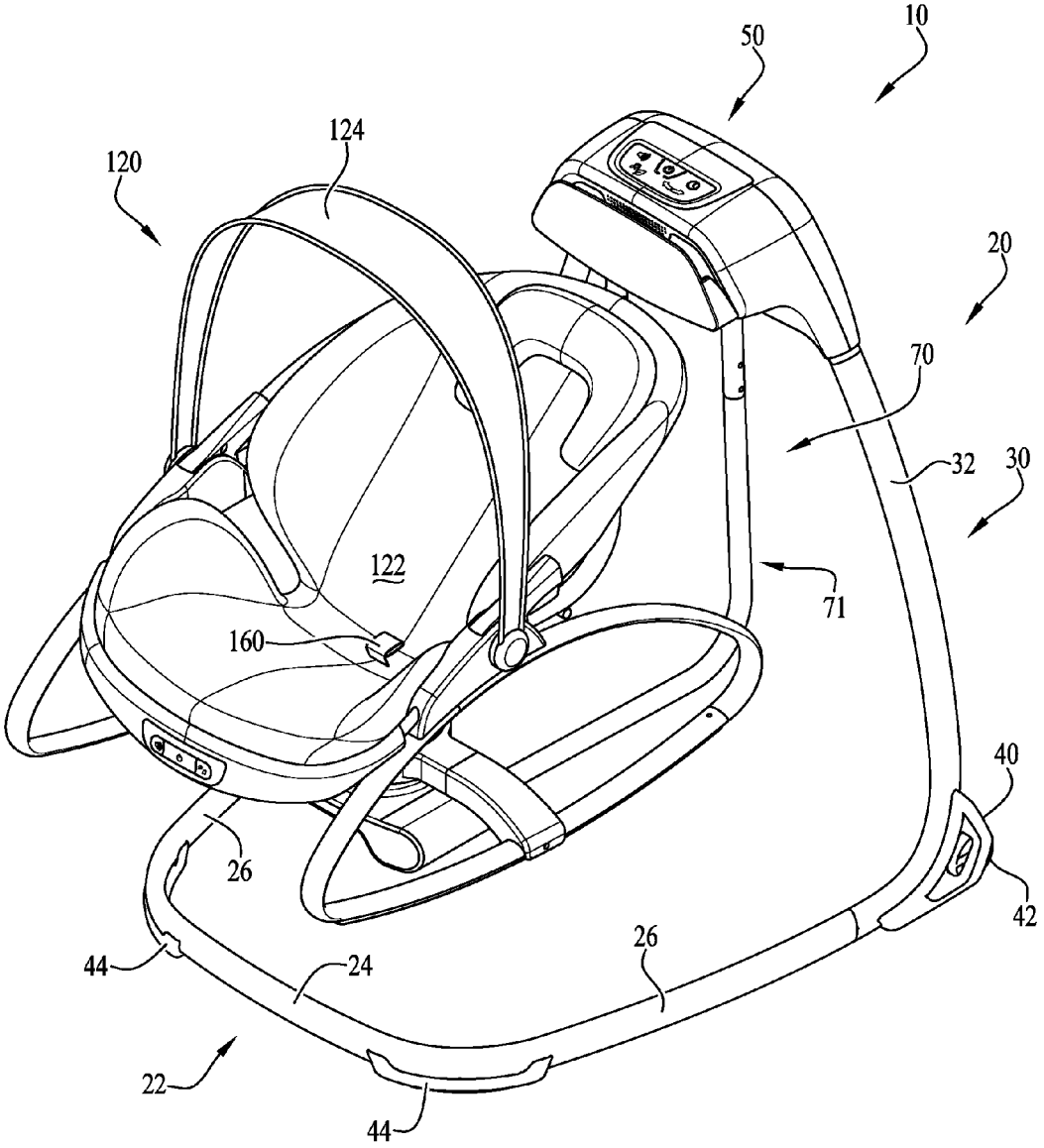
FIG. 1 is a front perspective view of a child motion device according to an example embodiment of the present invention, the child motion device having a child support portion in the form of a seat pivotally mounted to a support frame, the child support porting being an a front-facing orientation for side-to-side gliding movement.

With reference now to the drawing figures, wherein like reference numbers represent corresponding parts throughout the several views, FIG. 1 shows a child motion device 10 according to an example embodiment of the present invention. According to example forms, the child motion device 10 is formed as a children's glider swing, for example, to provide an overall gliding motion or gliding sensation to a child seated or supported on the child motion device 10. In example embodiments, the child motion device 10 comprises a support frame 20, a bridging strut member or frame hub 50, a gliding swing mechanism 70 pivotally mounted to the frame hub 50, and a child support portion 120 rotatably mounted to the gliding swing mechanism 70. In example embodiments, the child support portion 120 is a child seat that is removably and rotatably engageable with the gliding swing mechanism 70 for selectively positioning the child seat in multiple seat-facing orientations. As depicted in FIG. 1, the child support portion 120 is positioned in a front-facing orientation and configured for side-to-side gliding movement. Optionally, the child support portion 120 can be selectively rotated, for example about 90°, 180°, 270° and/or 360° (and/or other rotational increments) about a substantially vertical rotation axis X, allowing a left or right side-facing orientation for front-to-back gliding movement (see FIG. 5), or the child support portion 120 can be oriented in a front-facing or rear-facing orientation for side-to-side gliding movement (see FIG. 6). As will be described below, according to some example forms, one or more entertainment features of the child motion device 10 can be utilized depending on the orientation of the child support portion 120.

In example embodiments, the support frame 20 comprises a base portion 22 and an upright portion 30, and the frame hub 50 is supported by the support frame 20 and connects the upright frame portion 30 together. In example embodiments, the base portion 22 generally comprises a U-shaped member having a central support 24 connected and extending between a pair of side supports 26. The upright portion 30 comprises a pair of upright supports 32, which are connected to ends of the side supports 26 of the base portion 22. In example embodiments, the frame hub 50 provides a structural connection between the upright supports 32 of the upright frame portion 30, and can comprise a motor and controls for providing gliding movement to the child support portion 120. In example embodiments, the gliding swing mechanism 70 is supported and pivotally coupled to the frame hub 50, for example, wherein a pair of arms 71 (pivotally mounted to the frame hub 50) can swing in a side-to-side motion, thereby providing gliding movement to the child support portion 120. Thus, depending on the orientation of the child support portion 120, the child seated therein can experience a gliding sensation in either of a front-to-back gliding movement or a side-to-side gliding movement.

Figure 2:
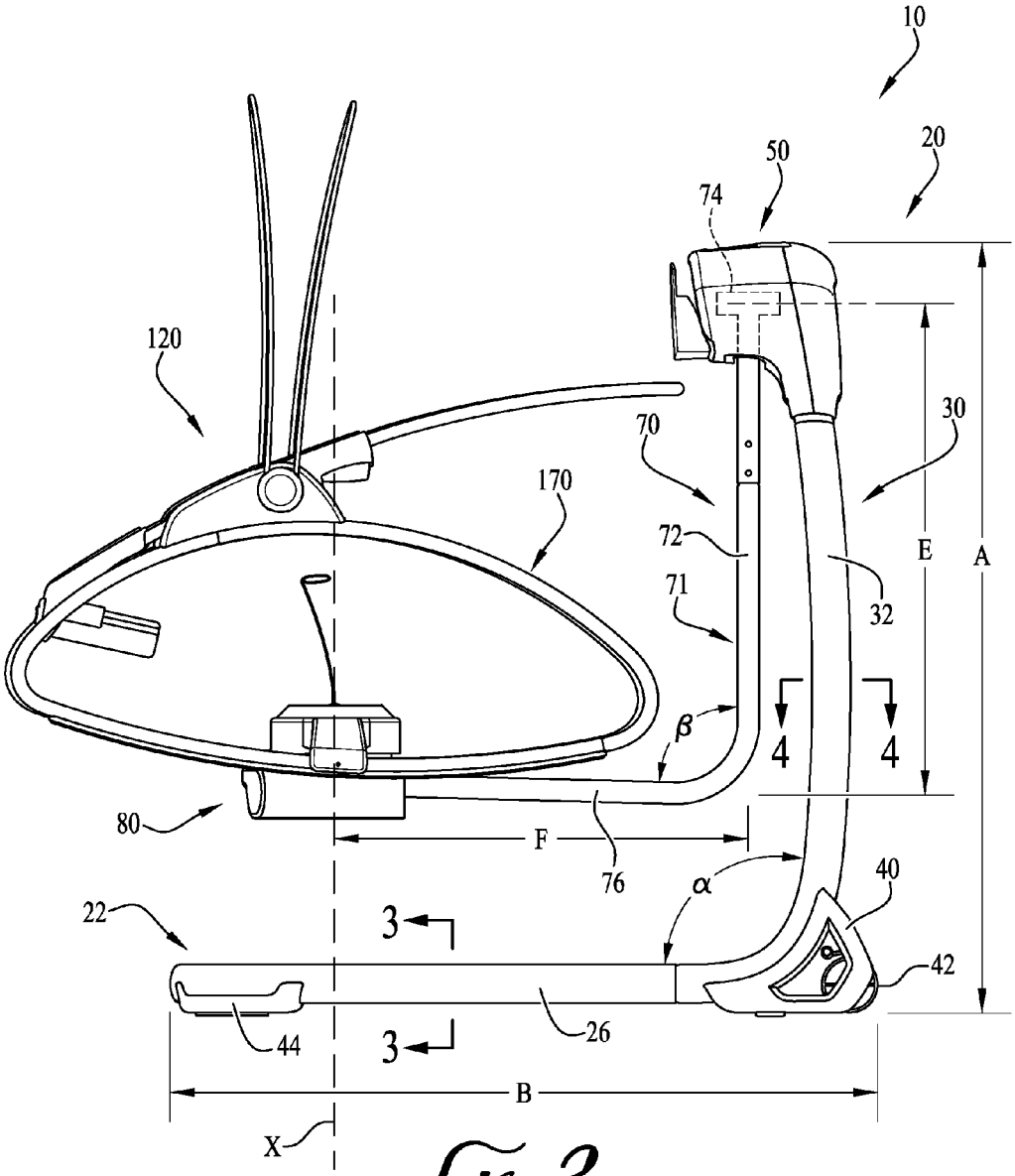
FIG. 2 is a side view of the child motion device of FIG. 1.

As depicted in FIG. 2, the support frame 20 is substantially compact and rigid, and supports the child support portion 120 that is removably attached to the gliding swing mechanism 70. In example embodiments, the base portion 22 is generally configured for being placed on a support surface, and the upright portion 30 is generally extending substantially vertically, for example, wherein an angle $\alpha$ is defined therebetween. In example embodiments, the angle $\alpha$ is between about 75-120 degrees, more preferably between about 85-100 degrees, for example, about 90 degrees according to one example embodiment.

Figure 3:
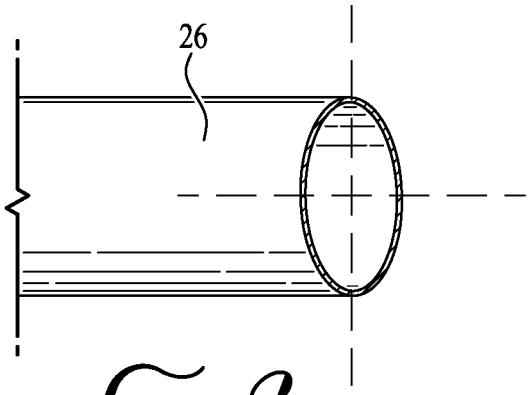
FIG. 3 is a cross-sectional view of a portion of the support frame of the child motion device of FIG. 2 taken along line 3-3.
Figure 4:
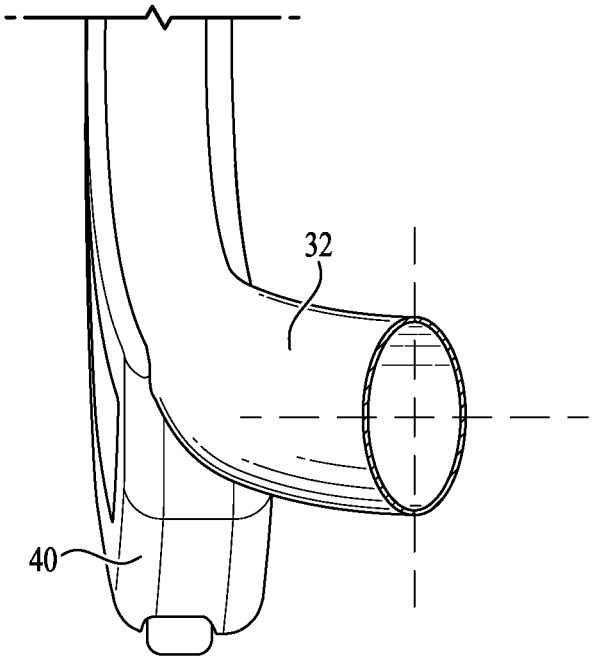
FIG. 4 is a cross-sectional view of a portion of the support frame of the child motion device of FIG. 2 taken along line 4-4.

In example embodiments, the central, side and upright supports 24, 26, 32 comprise an elliptical cross-sectional shape to strengthen the support frame 20 and resist bending thereof. For example, FIG. 3 shows a cross-sectional view of the side support 26 and FIG. 4 shows a cross-sectional view of the upright support 32. In example embodiments, as depicted in FIG. 4, the major axis of the upright support is oriented to be in a substantially similar axial direction relative to the pivots of the gliding swing mechanism, thereby providing a shape and dimension suitable for resisting bending forces when the child support portion 120 is engaged with the gliding swing mechanism 70 and a child is contained therein. Optionally, the cross-sectional shape of the central, side and upright supports can be shaped as desired, for example, oval, circular, rectangular, polygonal, irregular, etc., for example, to provide additional structural integrity and resistance to the bending thereof.

Figure 5:
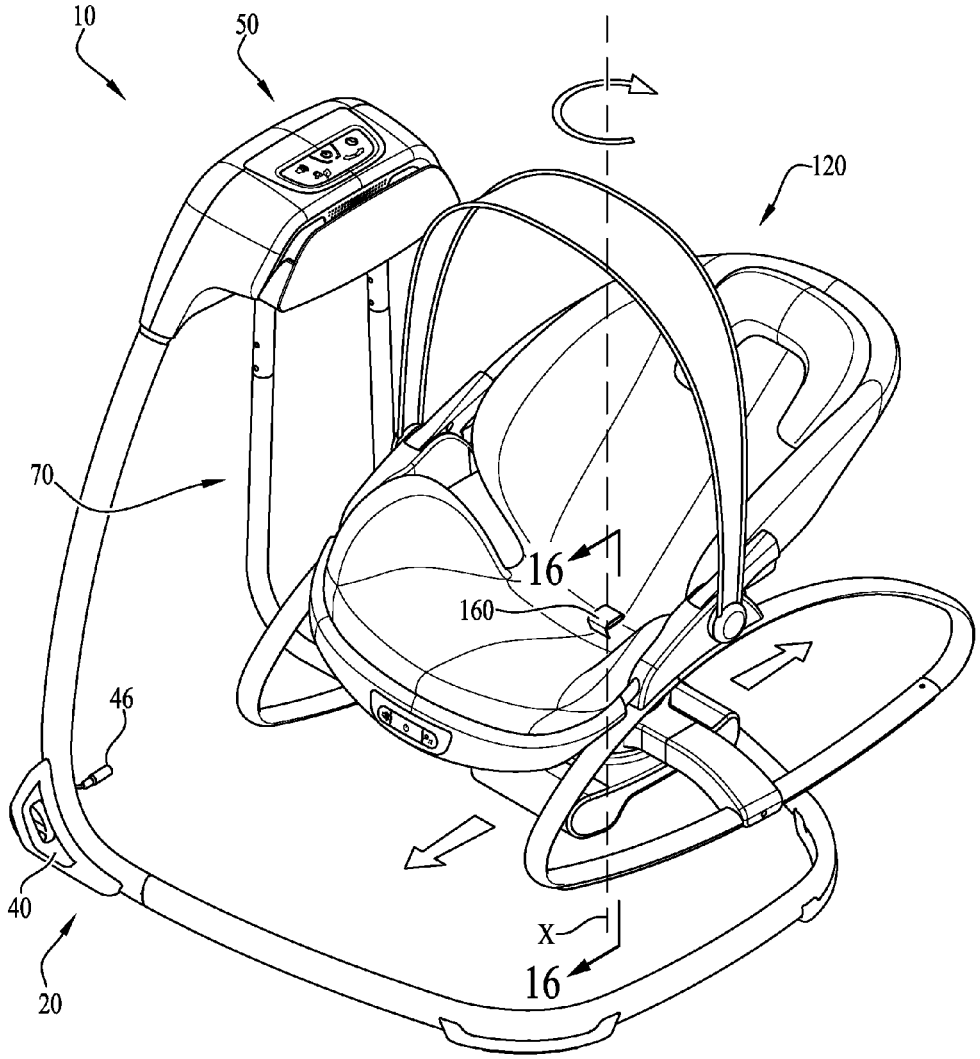
FIG. 5 is a perspective view of the child motion device of FIG. 1, and showing the seat oriented in a side-facing orientation for front-to-back gliding movement.

Optionally and as depicted in FIG. 2, the upright portions 32 are at least partially curved as they extend from connection with the base portion 22 to the frame hub 20. Optionally, one or more of the support portions of the frame 20 can be shaped and sized as desired, for example, without any curves and being substantially linear, or with one or more bends, curves or angled portions as desired. In example embodiments, the support frame 20 optionally further includes ground contacting support feet 40, 44 at corner portions of the U-shaped base portion 22 and at lower portions of the upright supports 32. Optionally, one or more of the support feet 40 include rollers 42 such as wheels or casters, to provide improved mobility and transportability to the child motion device 10. As depicted in FIG. 5, an A/C electrical adaptor cord or connector 46 optionally extends from a support foot 40 or other portion of the child motion device 10, to provide power to electronic components of the child motion device.

Referring back to FIG. 2, the support frame 20 is substantially compact and rigid, and is generally sized to provide for ease of mobility, for example, for moving between rooms in a home, or moving through narrow openings. According to example embodiments, the support frame 20 comprises a height A of between about 16-45 inches, a depth B of between about 16-45 inches, and a width C of between about 24-28 inches (see FIG. 9). For example, according to one example embodiment, the width C of the support frame comprises a maximum dimension of about 28 inches, for example, such that the child motion device 10 can easily fit through a standard interior door opening (e.g., about 2'-6" or 30"). Alternatively, the height A, depth B and width C of the support frame 20 can be otherwise sized as desired. In alternate example embodiments, one or more portions of the frame can be collapsible, or for example, can be foldable between an expanded configuration and a collapsed configuration.

Figure 8:
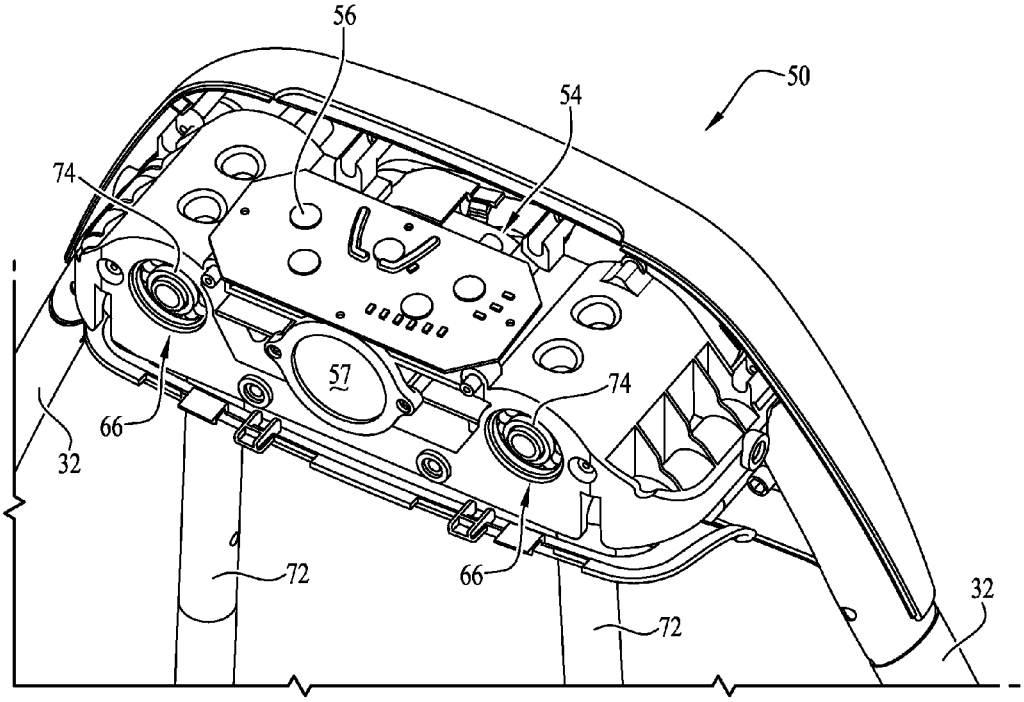
FIG. 8 is a detailed perspective view of the frame hub of FIG. 7, and wherein outer housing portions thereof are removed to show internal components thereof.

In example embodiments, a coupling member 80 pivotally mounts to the arms 71 of the gliding swing mechanism 70, thereby keeping the arms 71 spaced apart such that the child support portion 120 can be rotatably and removably mounted thereto, and in multiple seat configurations for providing either of a side-to-side (lateral) gliding movement or a front-to-back (longitudinal) gliding movement. In example embodiments, the gliding swing mechanism 70 generally comprises dual spaced-apart arms 71, which are pivotally mounted to the frame hub 50 at one end, and with the child support portion 120 cantilevered by the arms 71 extending from the pivots. Thus, the gliding swing mechanism 70 is generally configured as a four-bar linkage and with two of the ends of the arms 71 being cantilevered to support the coupling member 80 and child support portion 120 removably and rotatably mounted thereto. In example embodiments, each of the arms 71 comprises an upright portion 72, a transverse portion 74 formed at an end of the upright portion 72, and a base support portion 76. In example embodiments, the transverse portion 74 is pivotally mounted with the frame hub 50, for example, wherein a pair of roller bearings 66 support the arms 71 and permit pivoting thereof (see FIGS. 2 and 8).

As depicted in FIG. 2, in example embodiments the upright support portion 72 defines a height E of between about 10-22 inches and the base support portion 76 of the arms 71 defines a length F of between about 14-24 inches. In example forms, the height E is generally about equal to the length F. In some example forms, the height E is less than the length F, for example, to reduce the torque being applied to the roller bearings 66. In example embodiments, an angle β is defined between the upright portion 72 and the base support portion 76 is between about 75-100 degrees. According to example form, the angle β is generally less than 90 degrees, for example, such that when additional weight is applied to the child support portion 120, the angle β is generally less than or equal to about 90 degrees. Optionally, the angle β can be chosen as desired. According to example forms, the length F of the base support portion 76 is sufficient for permitting the child support portion 120 to rotate about the coupling portion 80, for example, to rotate the child support portion 120 between either of a front or rear facing orientation to a side-facing orientation, or vice versa (i.e., 50% the maximum lengthwise or widthwise dimension of the child support portion). For example, as will be discussed in greater detail below, the child support portion can comprise a rocking support frame 170, which permits the child support portion 120 to be used independently of the gliding swing mechanism 70, for example, for rocking on a support surface (see FIG. 23). Thus, in example embodiments, with the child support portion 120 comprising a rocking support frame 170, the base support portion 76 is sized to have a length F sufficient to permit rotation of the child support portion 120 while seated on the coupling portion 80.

Figure 6:
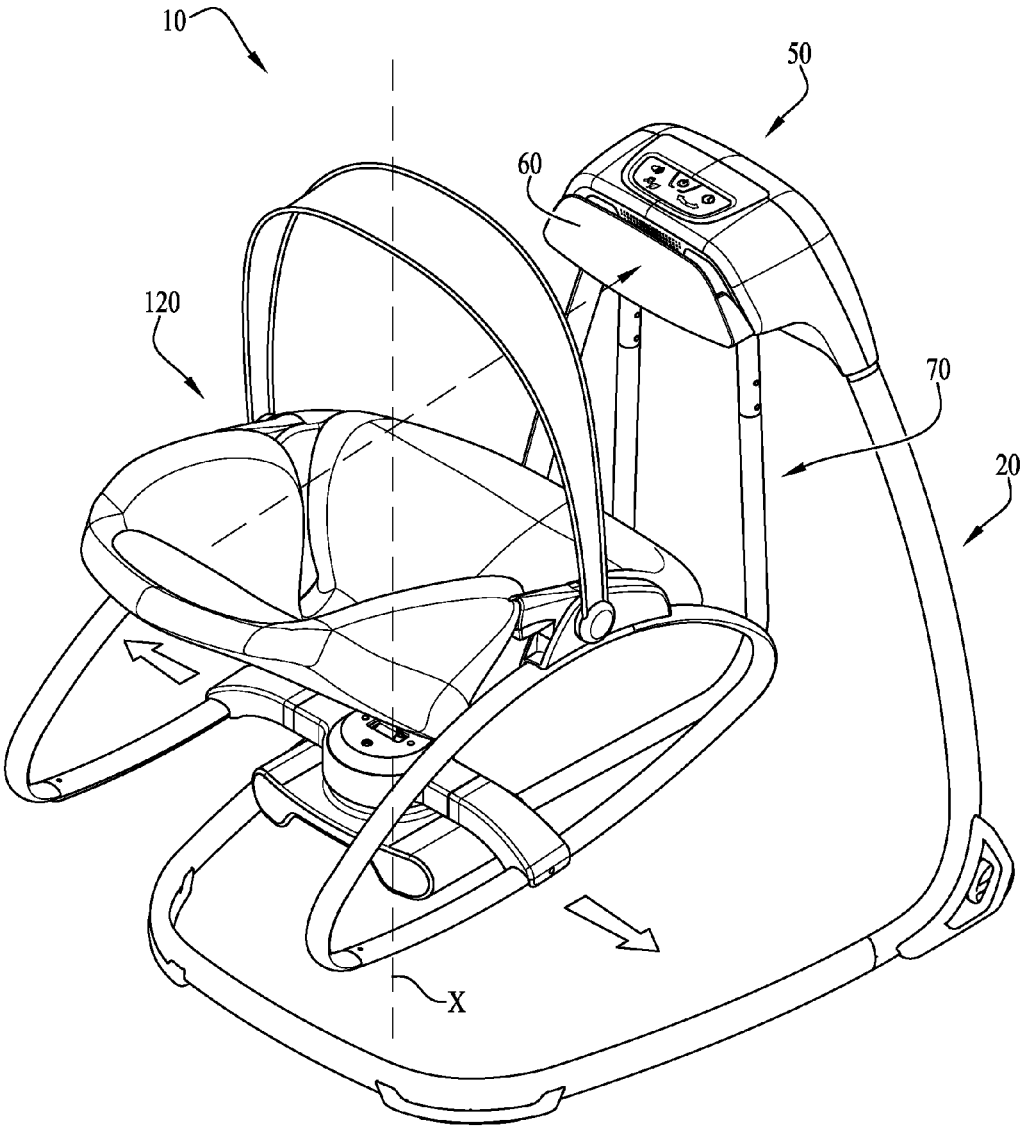
FIG. 6 is a perspective view of the child motion device of FIG. 5, showing the seat oriented in a rear-facing orientation for side-to-side gliding movement.
Figure 7:
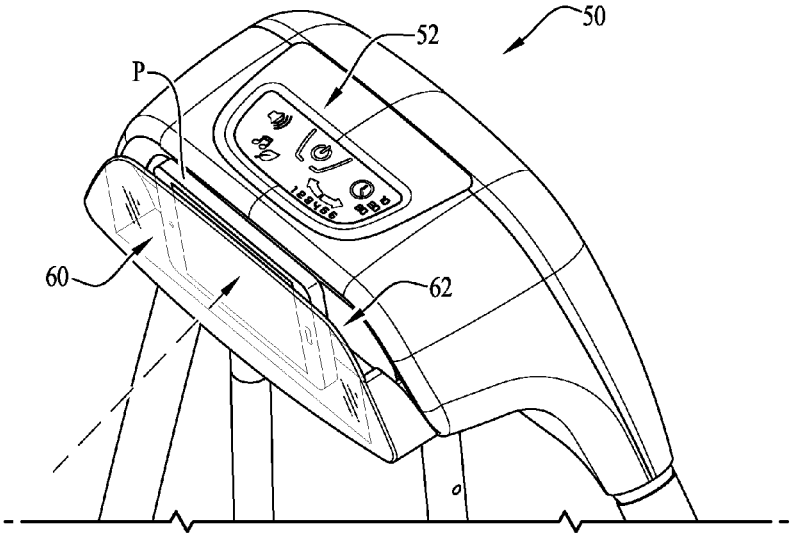
FIG. 7 is a close-up perspective view of a frame hub of the child motion device of FIG. 6.

FIG. 6 shows the child support portion 120 in a rear-facing orientation that is configured for side-to-side gliding movement of a child supported therein. According to example embodiments, a portion of the frame hub 50 comprises a display panel 60 for providing a soothing or visual effect, for example, to entertain the child while gliding back and forth. In example embodiments, the display panel 60 is easily viewable from the child's perspective when gliding side-to-side in the child support portion 120. According to example form, a direct line-of-sight view is provided between the child and the display panel 60 such that the child can easily see the display panel 60 throughout the gliding movement. In example embodiments, the display panel 60 can form a receptacle 62 for receiving an electronic device P (e.g., smart phone, tablet, etc.), which can be seen through the display panel 60 and is viewable to the child. The display panel 60 can be substantially transparent, or can be at least partially translucent such that a video or other viewable media that is presented on the electronic device P can be seen by the child and through the display panel 60. In example embodiments, the electronic device P can be connected to a speaker or sound emitting module of the frame hub 50. Optionally, the electronic device P can use its own internal speaker, or an additional external speaker can be provided.

In example embodiments, the frame hub 50 comprises an electronic control panel 52, which can include an on-off power switch, swing speed or amplitude controllers, a time, sound and music controls, electronic toys, video display, projectors, vibration unit, and/or controllers for sound, light, vibration or other features optionally provided in connection with the child motion device 10. In example embodiments, the control panel 52 can be formed from a circuit board 54, which is generally electrically connected with one or more of the optional entertainment accessories or other controllable portions of the device 10. According to one example embodiment, the circuit board 54 is configured for capacitive touch, for example, wherein one or more sensors are provided thereon for being touched by a user, for example, rather than a biased or mechanical switch. Optionally, the circuit board and controls provided thereon can be configured as desired. In example embodiments, a battery receptacle can be provided for providing and on-board power supply, or a rechargeable battery can be incorporated with the frame hub 50. As described above, an A/C electrical adaptor cord or connector 46 optionally extends from a support foot 40 or other portion of the child motion device 10, to provide power to electronic components of the child motion device, or to allow for recharging the on-board rechargeable battery.

Figure 9:
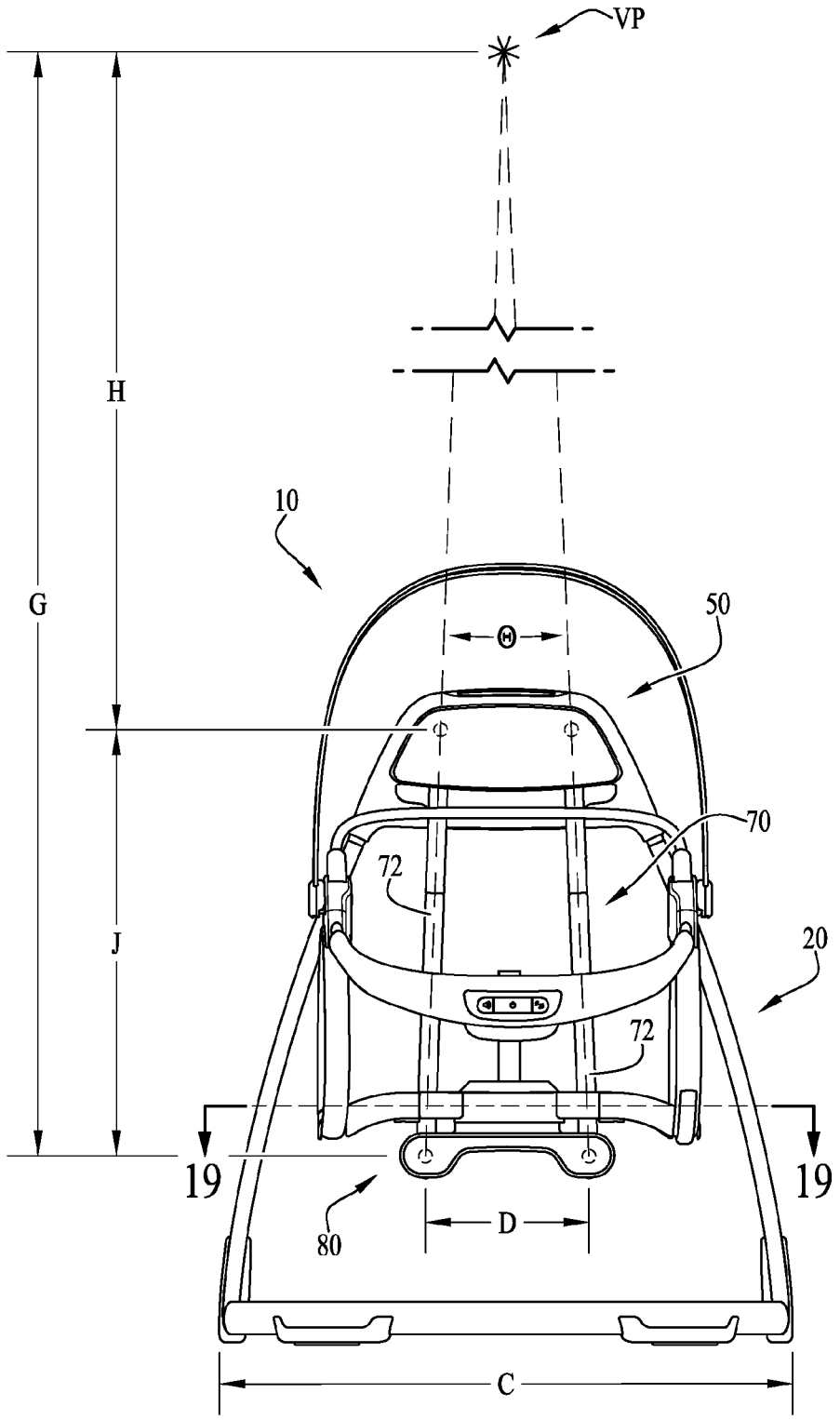
FIGS. 9, 10 and 11 are end views showing a range of gliding/swinging motion of the bassinet of FIG. 6.
Figure 10:
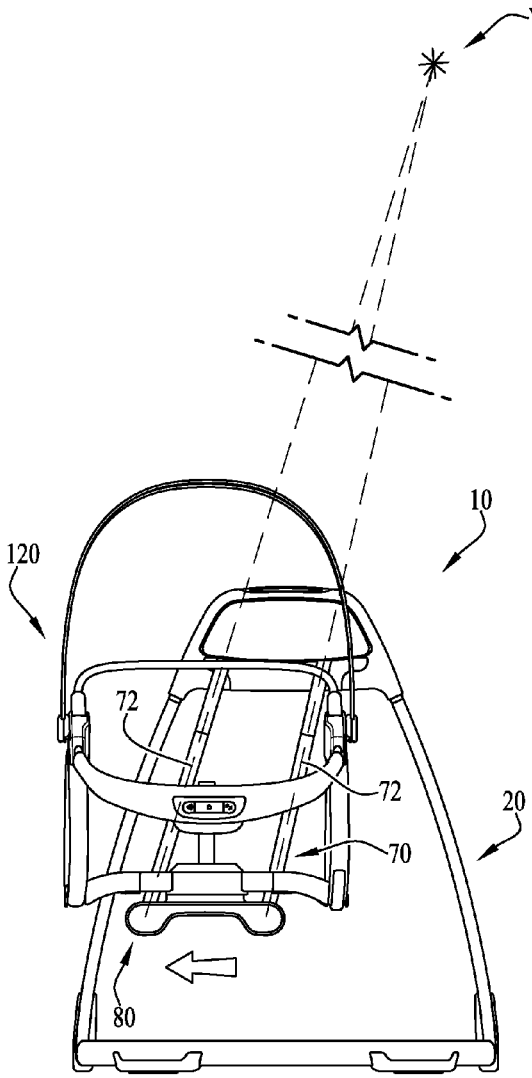
Figure 11:
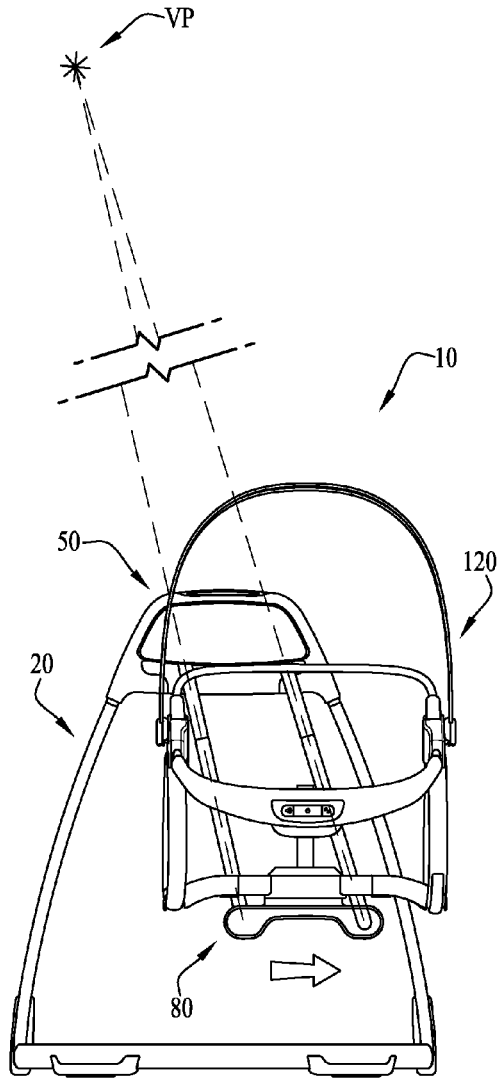

The gliding swing mechanism 70 is shown in greater detail in FIGS. 9-14. As recited above, the swing mechanism preferably supports the child support portion 120 that is suspended and cantilevered from the base support portions 76 of the arms 71, and allows the child support portion 120 to swing or glide laterally back and forth relative to the support frame 20, as shown in FIGS. 9-11. The swing mechanism 70 preferably maintains the coupling portion 80 in a generally flat and horizontal orientation throughout the range of gliding motion, limiting tilting or rolling motion of the child support portion, which could cause a child occupant to roll from one side to the other, potentially causing discomfort and distress to the child. According to one example form, the swing mechanism 70 does impart a combination of substantially horizontal gliding movement from one side to the other, and also includes at least some radial arcuate swinging or rolling motion. For example, according to example embodiments, the upright support portions are at least partially angled relative to each other, for example, such than an angle θ is defined therebetween. In example embodiments, the angle θ is between about 0-15 degrees, for example about 4-5 degrees, or about 4.5-4.8 degrees. Thus, in example embodiments, the base support portions 76 of the arms 71 are spaced apart and define a distance D, which is at least incrementally larger than the dimension defined between the pivotally-mounted transverse members 74 of the upright support portion 72, and thereby defines the angle θ therebetween. Optionally, the arms 71 are generally parallel and equally spaced apart at the coupling portion 80 and at the frame hub 50, for example, to provide a substantially horizontal side-to-side gliding movement. In alternative embodiments, the distance D may be larger, equal to or smaller than the dimension defined between the pivotally-mounted transverse members 74 of the upright support portion 72.

As depicted in FIGS. 9-11, with the arms 71 at least partially angled inwardly and upwardly relative to each other, a virtual pivot VP is defined where extension lines of the angled upright support portions eventually converge, for example, such that a minor amount of swing or arcuate, radial motion is imparted with the horizontal, side-to-side movement, thereby providing a side-to-side gliding movement having a generally flat arc with a limited rolling component of motion between the maximum side positions (see max positions in FIGS. 10-11). Thus, in some example forms, the side-to-side movement of the swing mechanism is generally between a flat, horizontal glide movement and a simple pendulum (substantially radial) swing motion. In example embodiments, at least partially angling the arms 71, provides some measure of angular momentum during the side-to-side gliding movement. According to one example embodiment, with the angle θ being about 4.76 degrees, a length G is defined between the virtual pivot VP and the pivots of the base support portions 76 with the coupling portion 80. Furthermore, a distance H is defined between the virtual pivot VP and the pivots of the transverse members 74 with the frame hub 50, and a distance J is defined between the pivots of the transverse members 74 and the frame hub 50 and the pivots of the base support portions 76 and the coupling portion 80. The distance G generally defines the radius of curvature of the rocking motion of the child support platform, and is preferably at least about 1.5-2.0 times the length J. According to example embodiments, the distance G is between about 50-100 inches, more preferably about 72 inches, the distance H is between about 25-75 inches, more preferably about 51 inches, and the distance J is between about 12-35 inches, more preferably about 21 inches.

Figures 12, 13:
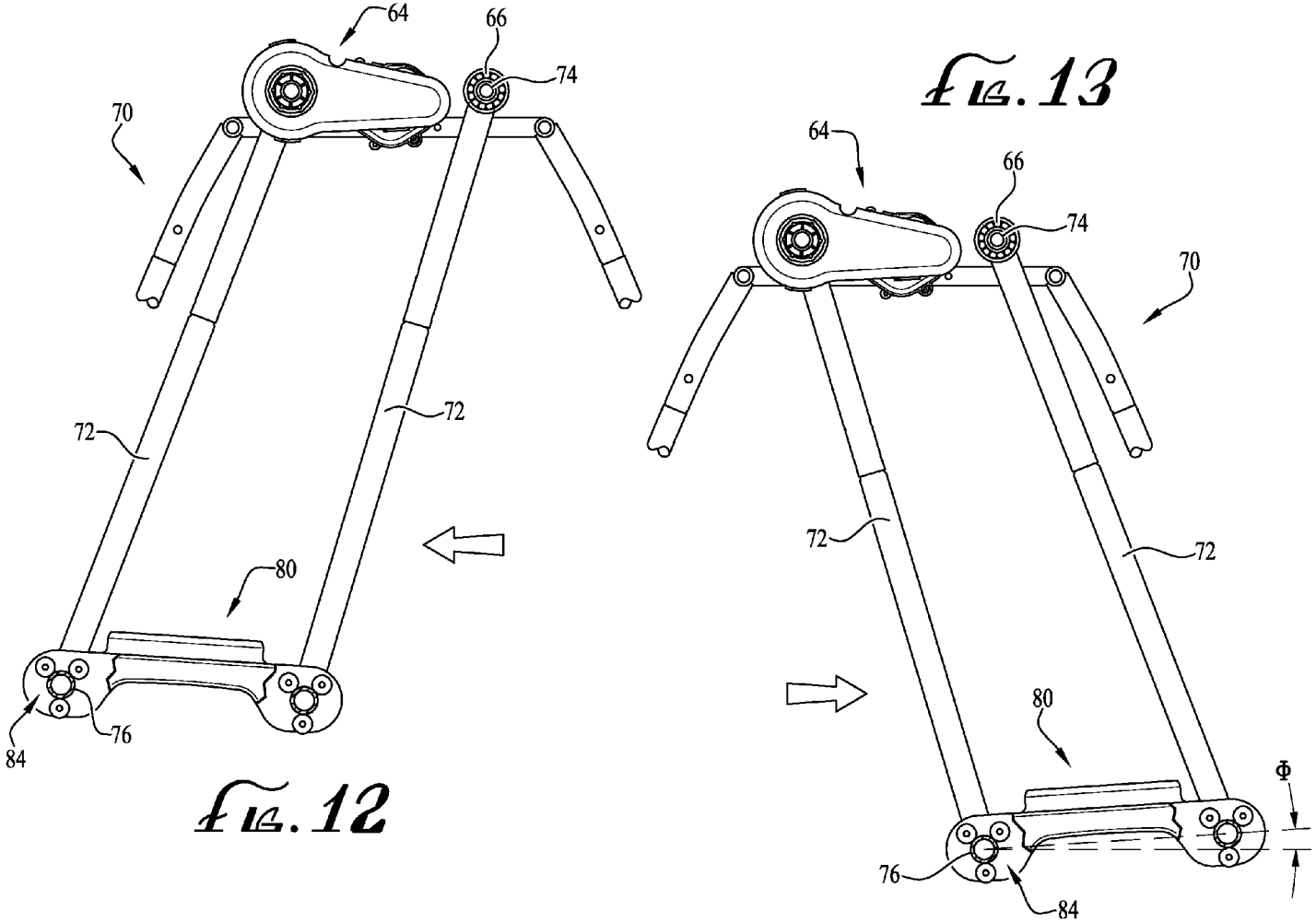
FIGS. 12-13 show further details of the gliding swing mechanism of the child motion device of FIG. 1 in partial cross-sectional and cutaway view.

For example, as depicted in FIGS. 12-13, the substantially flat arc provided by the angled upright supports 72 and virtual pivot VP causes the coupling portion 80 to define a roll angle φ relative to a horizontal axis. According to example embodiments, the roll angle φ at the maximum extent of the swing range is between about 1.5-6 degrees, for example, about 2.38 degrees according to one example embodiment. In example embodiments, a motor 64 can be provided and generally mechanically coupled to one of the transverse members 74 of the upright support portions 72, and the other transverse member 74 is generally pivotally mounted to the frame hub 50 and supported for pivotal movement by one or more roller bearings 66. In some example embodiments, the transverse member 74 of the motor-driven upright support portion 72 is additionally supported by roller bearings 66.

Figure 14:
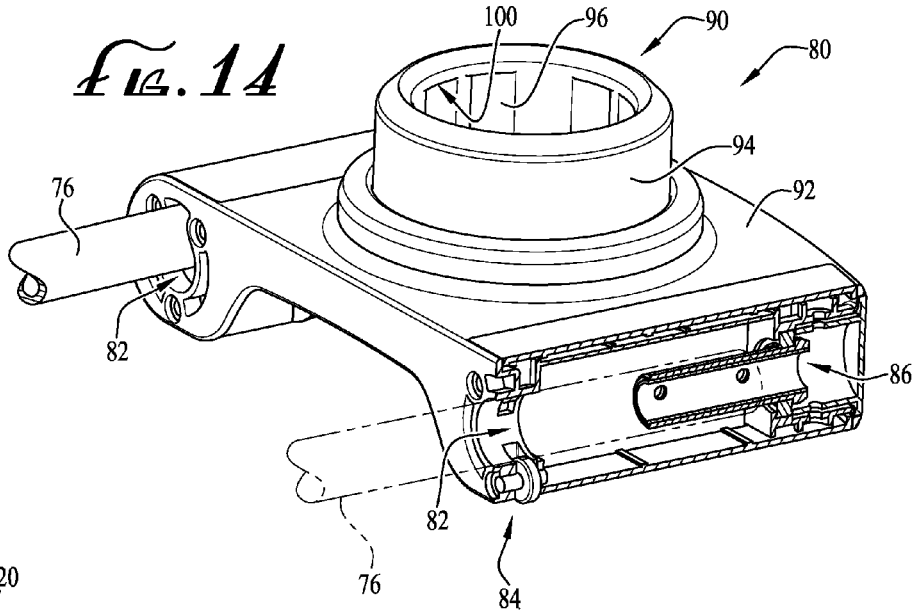
FIG. 14 is a perspective view of a coupling portion of the child motion device of FIG. 2.

The base support portions 76 of the swing arms 71 are pivotally coupled to the coupling portion 80, for example, extending through sleeves or channels 82 formed therein, into engagement with first and second bearing supports 84, 86, as shown in greater detail in FIG. 14. In example embodiments, the first bearing supports 84 are generally provided near the opening of the channels 82, for example, which can be formed from a circular array of pivotally mounted rollers, which are generally spaced-apart and lie along an circular path such that the outer periphery of the base support portions 76 is engaged with each of the rollers and is centrally-positioned to pivot. The second bearing supports 86 are generally in the form of sleeve bearings, for example, wherein a pivotally mounted tube that is internally mounted within the coupling portion 80 couples to the ends of the base support portions 76, thereby providing for a substantially supportive and friction-free pivot. Optionally, either or both of the first and second bearing supports 84, 86 can be replaced with rocker bearings, for example, including one or more male bearing struts and female bearing recesses as disclosed in U.S. Non-Provisional patent application Ser. No. 15/132,528, which is hereby incorporated herein by reference in its entirety. In example embodiments, the coupling portion 80 further comprises an upper coupling portion 90 comprising a platform 92 and a connection hub 94 for providing removable and rotatable engagement with the child support portion 120. In example embodiments, providing a child motion device comprising dual arms 71 as described herein, the coupling portion 80 is substantially more stable thereby providing additional stability to the child support portion 120, and thus, as described above, the support frame 20 can be more compact and easily maneuverable due to the greater stability.

In alternate embodiments, the coupling portion 80 can be configured for incorporation with the child support portion 120, for example, whereby the child support portion 120 comprises a bearing structure for pivotally mounting to the swing arms 71, rather than the bearing structure being provided on the swing arms (e.g., the coupling portion 80), and the child support portion being rotatably and removably mounted to the coupling portion 80, as described above.

Figure 15:
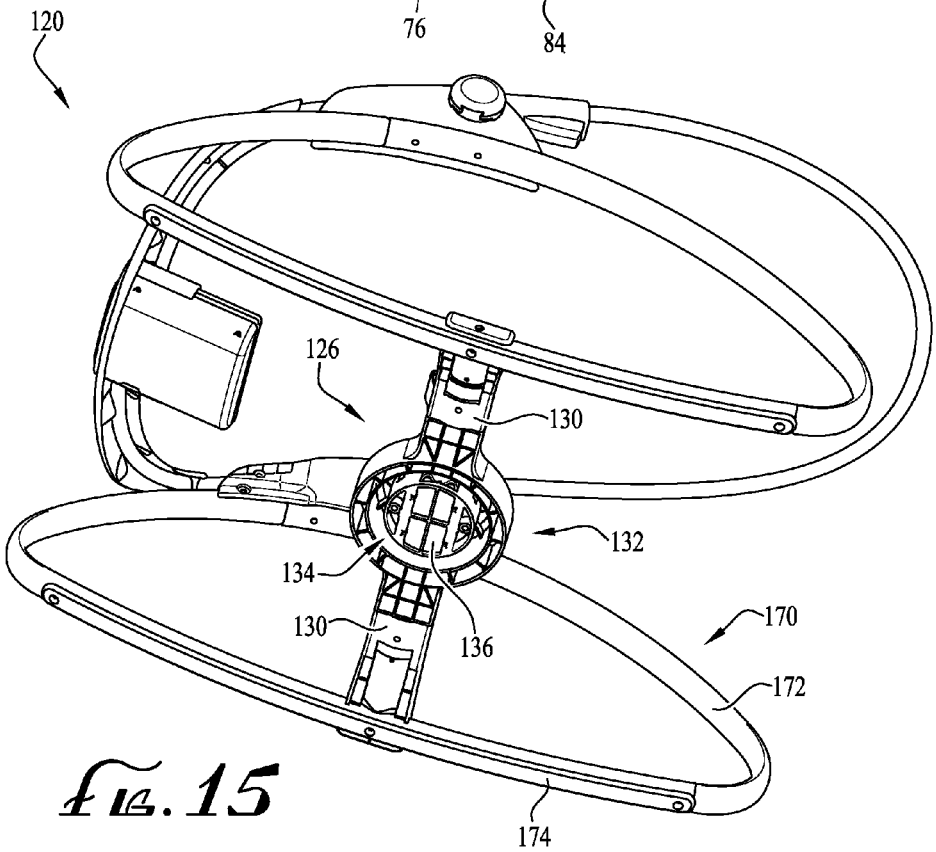
FIG. 15 shows a bottom perspective view of the child support portion of FIG. 1.

Referring to FIG. 15, the child support portion 120 comprises an outer frame structure 121 for receiving the child seat 122, and comprises a seat support portion 126 that is coupled to the support frame 170. In addition to the adjustment in seat-facing orientation, the outer frame structure is preferably adjustable, for example to provide more or less of a recline angle for a child seated within the seat 122. For example, in example embodiments, the seat support portion 126 comprises a pair of support arms 130 extending from a spaced-apart pair of base frame supports 172, and central connection hub 132 is generally centrally positioned and coupled to the support arms 130. The central connection hub 132 generally comprises a recessed ring or cavity 134 defined within an underside portion of the central connection hub 132, and a coupling member 136 is generally positioned to extend within at least a portion of the recessed cavity 134. In example embodiments, the coupling member 136 is releasably engageable with the coupling portion 80, for example, to provide for removably securing the child support portion 120 to the coupling portion 80, and for permitting selective rotation of the child support portion 120 relative to the coupling portion 80.

Figure 16:
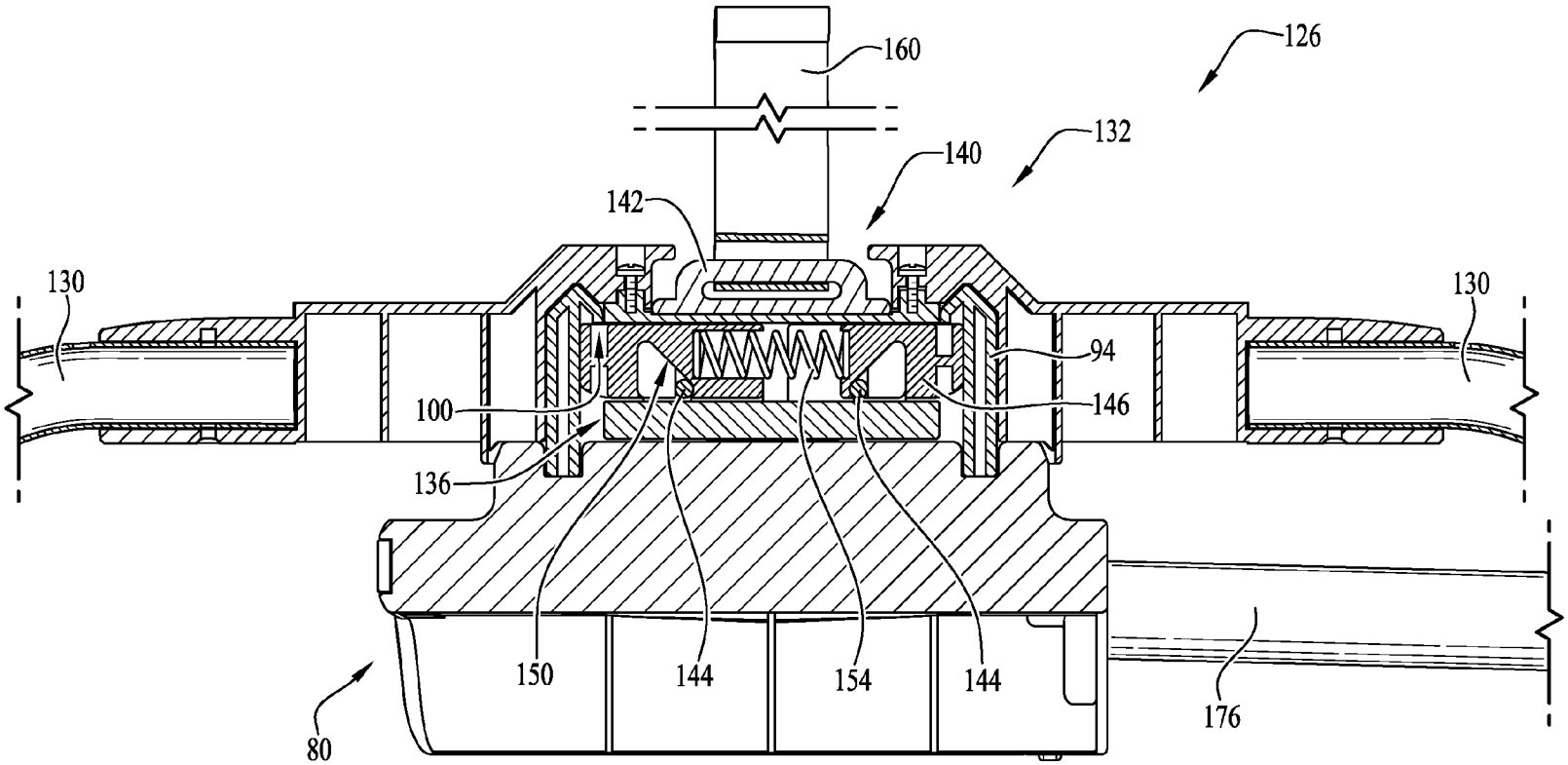
FIG. 16 is a cross-sectional view of a portion of FIG. 5 taken along line 16-16, showing the releasable connection provided between the coupling portion of the glide swing mechanism and the release mechanism of the child support portion.
Figure 17:
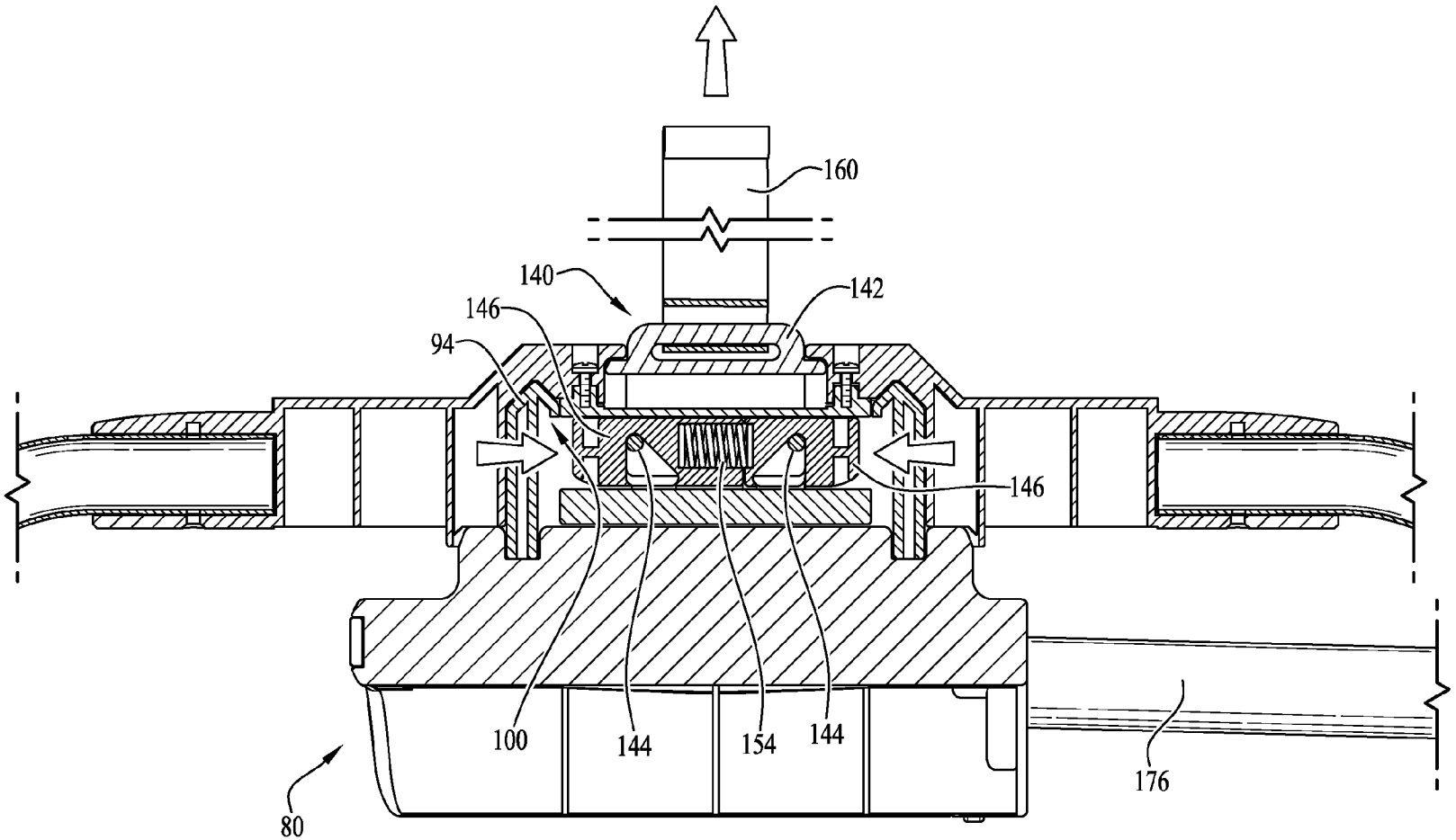
FIGS. 17-18 show a sequence of operation of the releasable connection of FIG. 16, showing actuation of a tether to retract a pair of release fingers, thereby allowing separation of the child support portion from the coupling portion.
Figure 18:
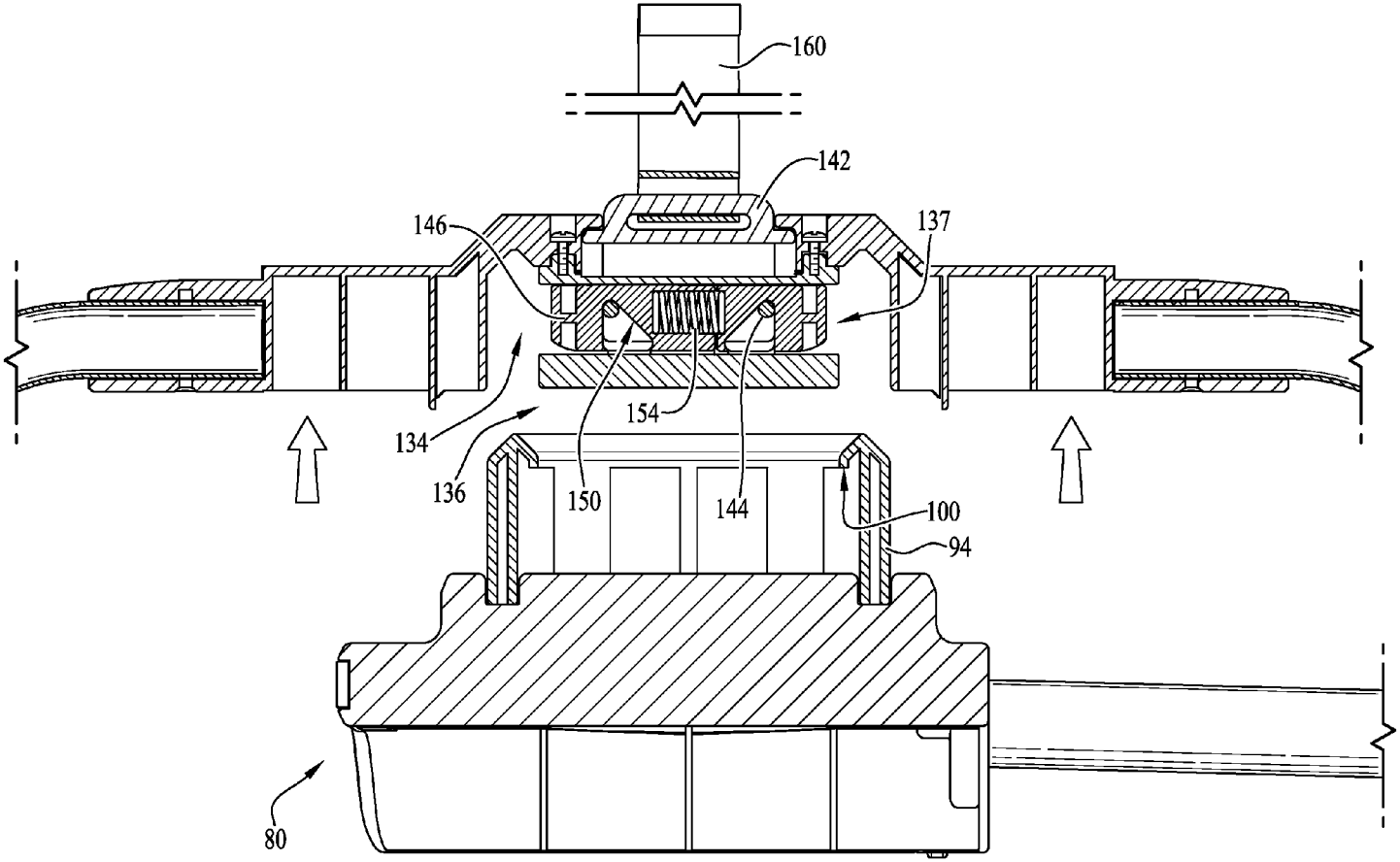
Figure 19:
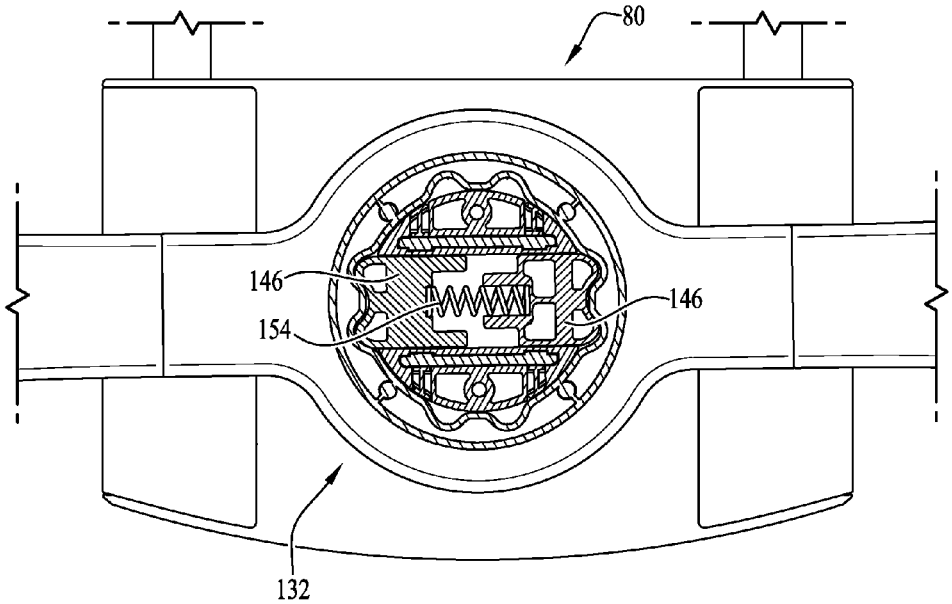
FIG. 19 shows a cross-sectional view of the releasable connection provided between the coupling portion and the child support portion of FIG. 9 taken along line 19-19, showing the release fingers fully engaged with the coupling portion.

FIGS. 16-18 show a sequence of operation of the releasable coupling engagement of the seat support portion 126 with the coupling portion 80. In example embodiments, the coupling member 136 comprises a release mechanism 140 that provides for selectively permitting removal of the child support portion 120 from the coupling portion 80, or for selectively rotating the child support portion 120 relative to the coupling portion 80, for example, for adjusting between the front-facing, side-facing and rear-facing orientations to impart either the front-to-back gliding movement, or the side-to-side gliding movement. As depicted in FIG. 16, the connection hub 132 of the seat support portion 126 is fully engaged with the coupling portion 80, for example, such that the coupling member 136 is seated and releasably engaged with the coupling ring 94. In example embodiments, the release mechanism 140 of the coupling member 136 comprises a central block member 142, a pair of movable release fingers 146 that are guided within a channel 137 formed in the coupling member 136, a biasing member 154 positioned between the release fingers 146 for biasing the release fingers 146 outwardly and against one or more surface features 96 of the coupling ring 94, and a tether 160 coupled to the central block member 142 (see FIGS. 19-20).

In example embodiments, the coupling ring 94 comprises an internal surface comprising a radial array of about four surface features 96, for example, which are generally formed in pairs and generally shaped accordingly with the shape of the release fingers to provide complementary interengagement therewith. For example, according to example embodiments, the radial array of surface features 96 is such that the release fingers 146 can become interengaged therewith when the child support portion 120 is in either of the front-facing, rear-facing or side-facing orientations, or for example, wherein the minimum degree of adjustment is about 90 degrees. In alternate example forms, the circular array can comprise a plurality of surface features 96 such that the minimum degree of adjustment can be between about 0.5-15 degrees, or for example, about 45 degrees. According to example embodiments, each of the surface features 96 comprises an upper stop portion or overhang 100, which is preferably provided for engagement with the release fingers 146, for example, to maintain engagement between the seat support portion 126 and the coupling portion 80. Thus, according to example embodiments, the engagement of the release fingers 146 with the surface features 96 preferably prevents rotation of the seat support portion 126 (and child support portion 120 thereof) relative to the coupling portion 80, and the overhang 100 of the coupling ring 94 preferably acts as a stop to prevent separation of the coupling member 136 from the coupling ring 94.

In example embodiments, the release fingers 146 and the surface features 96 preferably have complementary shapes, for example, a pair of male radiused projections for interengaging with a pair of female radiused recessed. Optionally, the fingers and surface features can be shaped as desired, or can comprise other interengagement members, complementary couplings or connectors, etc.

In example embodiments, the block member 142 comprises a pair of spaced-apart bosses 144 generally extending transversely from the block member 142, which are configured for respective engagement with cam surfaces 150 formed within each of the release fingers 146. In example embodiments, a generally elongate channel 137 (see FIG. 18) is formed within the coupling member 136 and provides a path for the release fingers 146 to move, for example, within and out of the channel, depending on whether the block member 142 is being pulled upwards. In example embodiments, with the release fingers being biased outwardly and each being engaged with one of the bosses 144, the bias of the biasing member 154 causes the release fingers 146 to extend outwardly, thereby causing the release fingers to interengage with an opposing pair of the surface features 96, and causing downward retraction of the block 142, for example, as the bosses 144 move along the cam surfaces 150 of the release fingers 146.

As depicted in FIG. 17, as the tether 160 is pulled upwards, the block 142 is moved upwards, thereby moving the bosses 144 upwards and further causing the release fingers 146 to retract. As the bosses move with the block 142, the release fingers 146 are forced to retract within the channel 137 and against the bias of the biasing member 154 (see FIG. 20). Once the block 142 is positioned in its fully retracted state (see FIG. 17), the release fingers 146 are retracted at least enough to allow for separation of the coupling member 136 with the coupling ring, for example wherein the ends of the release fingers 146 are no longer under or prone to engagement with the overhang 100 of the coupling ring 94. As depicted in FIG. 18, with tension still being applied to the tether 160, the seat support portion 126 can then be separated from the coupling ring 94, and thus allowing for separation of the child support portion 120 from the coupling portion 80. In example embodiments, if a caregiver is rather only trying to adjust the seat-facing orientation, tension can be applied to the tether 160 with the coupling member 136 remaining seated within the coupling ring 94, and as the release fingers 146 are fully retracted, the child support portion 120 can then be rotated to any desired seat-facing orientation.

In example embodiments, to couple the child support portion 120 to the coupling portion 80, tension need not necessarily be applied to the tether 160, for example, as the release fingers can be shaped such that they slidingly engage with a portion of the coupling ring 94 during the attachment thereof. In example embodiments, the bottom corner portions of the release fingers 146 are at least partially radiused to engage an upper portion of the coupling ring 94 during engagement therewith, for example, such that the fingers retract as they pass the overhang 100, and then expand again and within the surface features to an engaged and locked configuration. In example embodiments, the tether 160 is generally coupled to a slot or opening of the block member 142, and extends through the seat 122. In example embodiments, the tether 160 and its position within the seat is generally configured as a passive safety release mechanism, for example, as actuation of the tether 160 must wait until the child in removed from the seat 122. As such, before the seat 122 can be rotatably repositioned or disengaged from the coupling ring 94, the child is removed and tension is applied to the tether 160 (see FIGS. 1 and 5).

Figure 23:
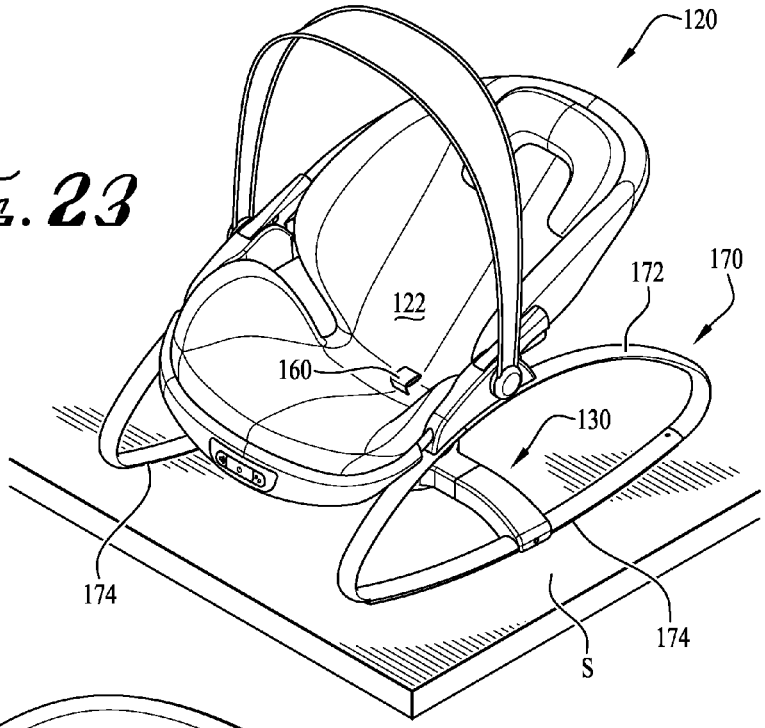
FIG. 23 shows a perspective view of the child support portion of FIG. 1, wherein the child support portion is removed from the support frame for rocking in a front-to-back movement atop a support surface.

In example embodiments, the child support portion 120, once disengaged from the coupling portion 80, can be utilized as a rocker for resting atop a support surface, for example, as depicted in FIG. 23. In example embodiments, the support arms 130 are mounted to an interior portion of the base frame supports 172, for example, so that the curved lower rocking supports 174 provide substantially smooth and continuous engagement with the support surface S as the child support portion 120 rocks in a front-to-back rocking motion.

Figure 20:
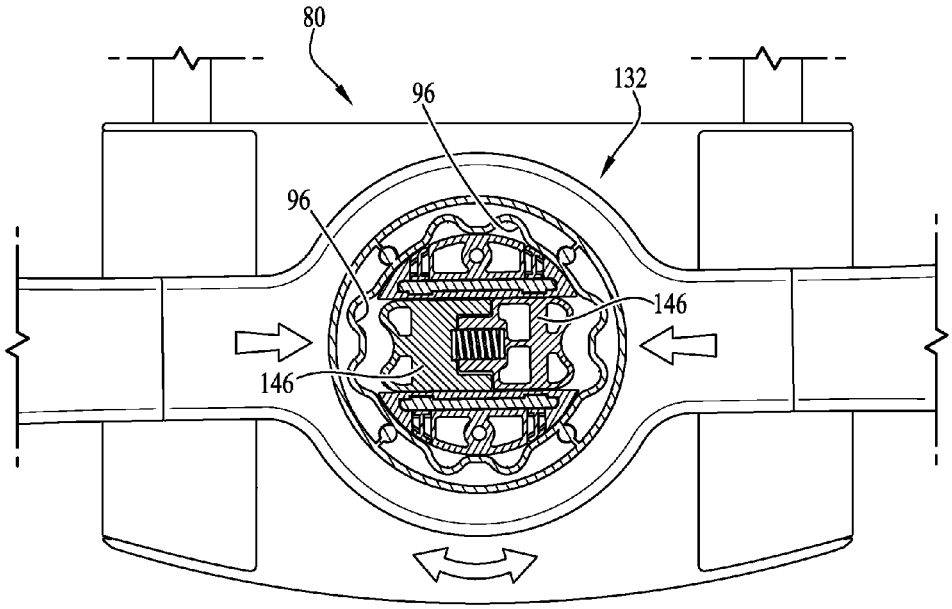
FIG. 20 shows a cross-sectional view of the releasable connection of FIG. 19, wherein the release fingers are retracted inwardly to allow for separation of the child support portion from the coupling portion.
Figure 21:
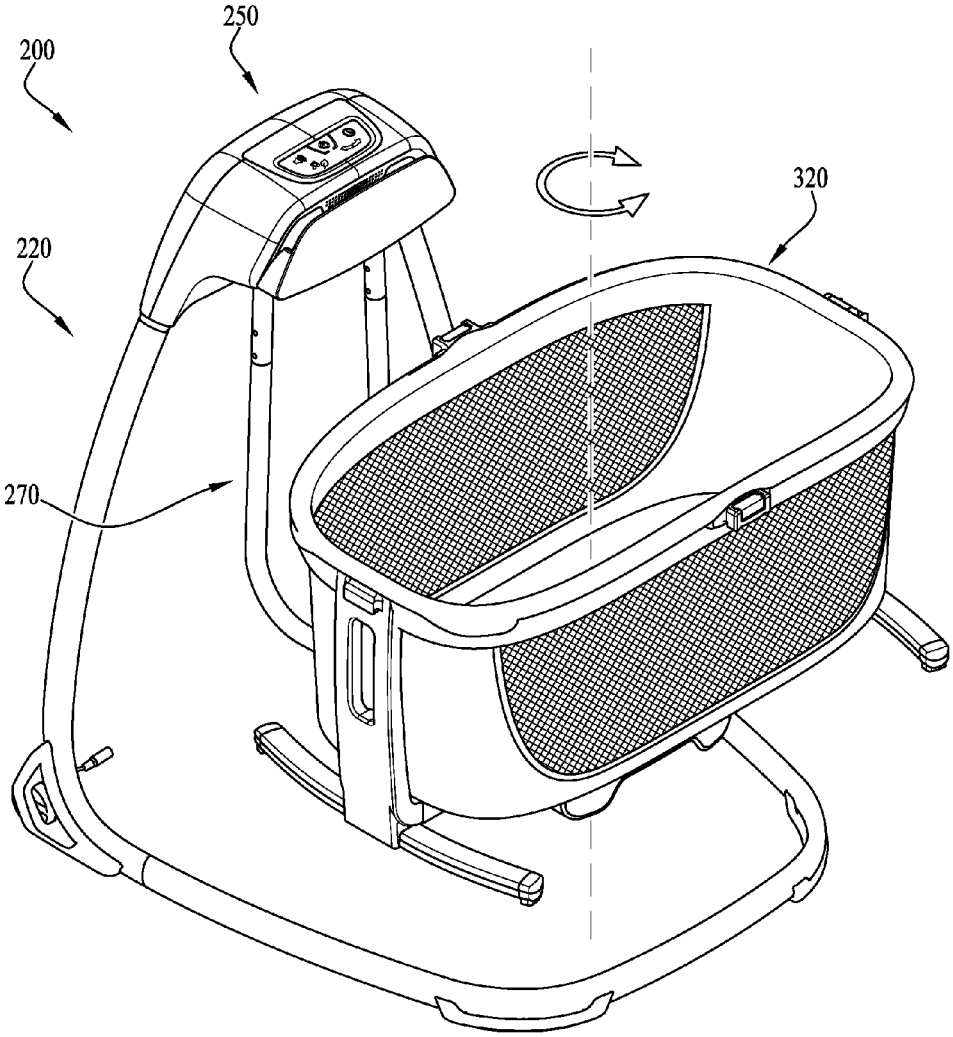
FIG. 21 is a perspective view of a child motion device according to another example embodiment of the present invention, wherein the child motion device includes a child support portion in the form of a bassinet pivotally mounted to a support frame, the child support portion being in a side-facing orientation for front-to-back gliding movement.
Figure 22:
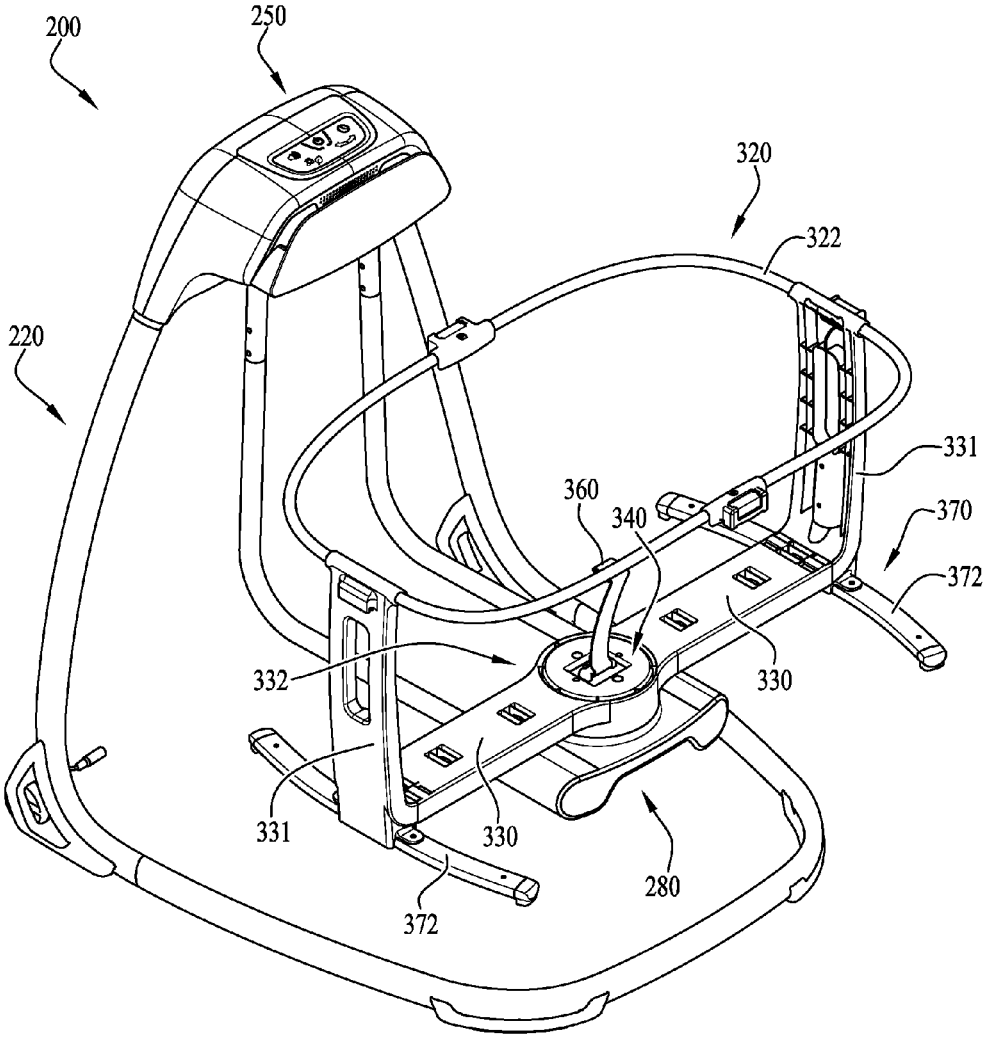
FIG. 22 shows the child motion device of FIG. 21, wherein portions of the child support portion are removed to show hidden portions thereof.
Figure 24:
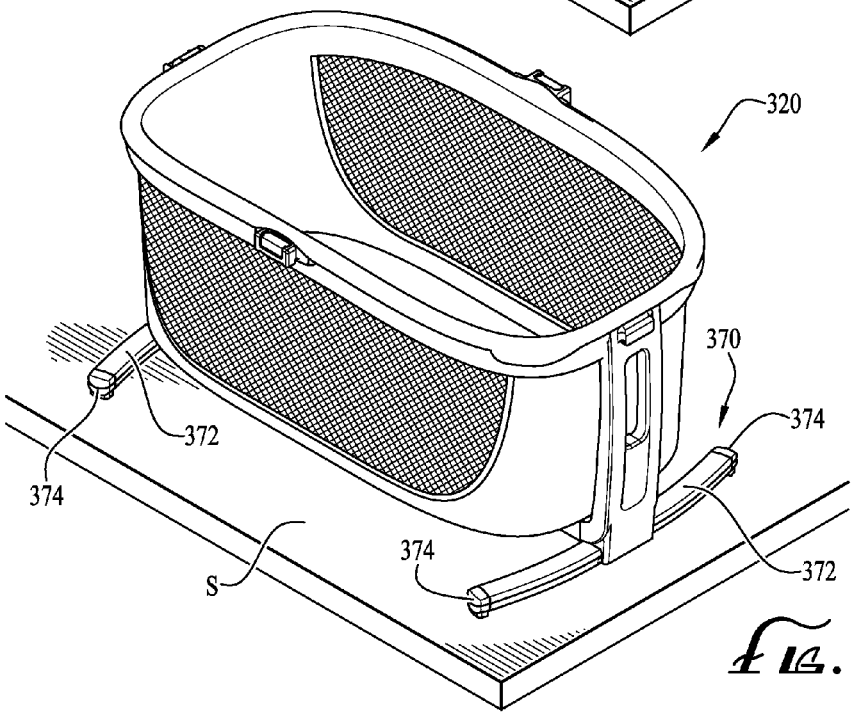
FIG. 24 shows a perspective view of the child support portion of FIG. 21, wherein the bassinet is removed from the support frame for resting atop a support surface.

FIGS. 20-21 show a child motion device 200 according to another example embodiment of the present invention. As depicted, the child motion device 200 is substantially similar to the child motion device 10 as described above, for example, comprising a support frame 220, a frame hub 250, a swing mechanism 270, a coupling portion 280 and a child support portion 320. In example embodiments, the child support portion 320 is in the form of a bassinet, for example, which generally comprises an upper frame ring 322, a lower support portion 330, upright supports 331, a central connection hub 332, a release mechanism 340, and a tether 360. In example embodiments, the bassinet comprises a support frame 370 having base frame supports 372, for example, for resting the bassinet atop a support surface (see FIG. 24). Preferably, as depicted in FIG. 21, the bassinet can be positioned in multiple seat-facing orientations, or for example, can at least be configured to permit either side-to-side gliding movement, or front-to-back gliding movement.

Accordingly, as depicted in FIGS. 20-21, the child motion devices 10, 200 as described herein can preferably provide for the interchangeability of either of the child support portions, for example, either the child seat or the bassinet. Thus, in example embodiments, the caregiver can easily interchange one of the child support portions for the other, for example, by removing one of the child support portions and replacing it with the other, or vice versa, depending on what is desired to contain the child during the gliding movement.

While the invention has been described with reference to example embodiments, it will be understood by those skilled in the art that a variety of modifications, additions and deletions are within the scope of the invention, as defined by the following claims.

What is claimed is:

1. A child motion device comprising:

a support frame comprising a base portion configured for resting on a support surface, an upright portion of the support frame extending upward from the base portion, and a frame hub mounted at a top end of the upright portion of the support frame opposite the base portion;

a pair of swing arms, each having a first end pivotally coupled to the frame hub of the support frame, an upright swing arm portion suspending generally downward from the first end, and a base support portion extending cantilevered from the upright swing arm portion; and a child support portion detachably coupled to the cantilevered base support portions of the pair of swing arms such that a swinging side-to-side motion of the pair of swing arms generates in the child support portion a gliding side-to-side motion;

wherein the child support portion comprises a lower support portion comprising at least one support arm and a connection hub for detachably coupling to the cantilevered base support portions of the pair of swing arms, and first and second base frame support members attached at opposite ends of the lower support portion, whereby the child support is reconfigurable between a first mode wherein the child support portion is coupled to the support frame and a second mode wherein the child support portion is detached from the support frame and is supported by the first and second base frame support members on a support surface independent of the support frame.

2. The child motion device of claim 1, the base portion of the support frame comprising a substantially U-shaped member.

3. The child motion device of claim 1, the frame hub including a motor for inducing side-to-side motion in the pair of swing arms.

4. The child motion device of claim 1, the frame hub comprising an electronic control panel.

5. The child motion device of claim 4, the electronic control panel usable to control movement of the pair of swing arms.

6. The child motion device of claim 4, the electronic control panel usable to control vibration of the child support portion.

7. The child motion device of claim 4, the frame hub further including a display panel.

8. The child motion device of claim 7, the electronic control panel usable to provide entertainment via the display panel.

9. The child motion device of claim 4, the electronic control panel includes a capacitive touch sensor.

10. The child motion device of claim 1, the frame hub defining a recess for receiving an electronic device.

11. The child motion device of claim 1, further comprising a coupling portion attached to the base support portions of the swing arms for detachable coupling with the connection hub of the child support portion.

12. The child motion device of claim 11, further comprising a mechanism preventing release of the connection hub of the child support portion from the coupling portion when the child support portion is occupied.

13. The child motion device of claim 1, wherein an angle of between about 75°-120° is defined between the base portions of the support frame and the upright portion of the support frame.

14. The child motion device of claim 1, wherein an angle of about 85°-100° is defined between the base portions of the support frame and the upright portion of the support frame.

15. The child motion device of claim 1, wherein an angle of about 90° is defined between the base portions of the support frame and the upright portion of the support frame.

16. The child motion device of claim 1, wherein the pair of swing arms are oriented at an acute angle relative to one another such that a virtual pivot axis is defined at a location in space above the frame hub at an intersection of extension lines of the upright swing arm portions of the pair of swing arms.

17. The child motion device of claim 16, wherein the acute angle between the first and second swing arms is between about 0°-15°.

18. The child motion device of claim 16, wherein the acute angle between the swing arms is between about 4°-5°.

19. The child motion device of claim 1, the swinging side-to-side motion of the pair of swing arms generating in the child support portion a gliding side-to-side motion having a roll angle between about 1.5°-6°.

20. The child motion device of claim 1, the base portion and the upright portion of the support frame having a cross-section substantially oval in shape.

21. The child motion device of claim 1, the base portion and the upright portion of the support frame having a cross-section substantially polygonal in shape.

22. The child motion device of claim 1, the base portion and the upright portion of the support frame having a cross-section substantially elliptical in shape.

23. The child motion device of claim 1, the support frame having a maximum width of 28 inches.

24. The child motion device of claim 1, the support frame having a height between 16 and 45 inches.

25. The child motion device of claim 1, the child support portion pivotably coupled to the cantilevered base support portions of the pair of swing arms by roller bearings.

26. The child motion device of claim 1, the child support portion rotationally repositionable relative to the pair of swing arms.

27. The child motion device of claim 26, the child support portion rotationally repositionable relative to the pair of swing arms such that swinging side-to-side motion of the pair of swing arms generates in the child support portion a gliding front-to-back motion.

28. The child motion device of claim 1, the child support portion comprising one of a child seat and bassinet.

29. The child motion device of claim 1 further comprising a rechargeable battery.

30. The child motion device of claim 1, a portion of the support frame being collapsible.

31. The child motion device of claim 1, wherein the child support portion comprises base frame supports for supporting the child support portion on the support surface in the second mode, independent of the support frame.

32. The child motion device of claim 31, wherein the base frame supports further comprise curved lower rocking supports for rocking the child support portion on the support surface in the second mode, independent of the support frame.

* * * * *